United States Patent [19]

Eshleman

[11] 4,306,501

[45] Dec. 22, 1981

[54] OMNI-DIRECTIONAL IMPACT ACTUATED SYSTEM

[75] Inventor: Ralph G. Eshleman, Lancaster, Pa.

[73] Assignee: Hamilton Technology, Inc., Lancaster, Pa.

[21] Appl. No.: 53,975

[22] Filed: Jul. 2, 1979

[51] Int. Cl.[3] ..... F42C 1/06; F42C 9/02

[52] U.S. Cl. ..... 102/273; 102/274; 102/276

[58] Field of Search ..... 102/273, 274, 272, 276, 102/265, 257, 255

[56] References Cited

U.S. PATENT DOCUMENTS

| | | | |
|---|---|---|---|
| 1,318,098 | 10/1919 | Midgley | 102/273 X |
| 3,369,520 | 2/1968 | Burg et al. | 102/273 |
| 3,407,667 | 10/1968 | Doeringsfeld | 102/273 X |

FOREIGN PATENT DOCUMENTS

| | | | |
|---|---|---|---|
| 130017 | 7/1919 | United Kingdom | 102/273 |
| 131025 | 8/1919 | United Kingdom | 102/273 |

*Primary Examiner*—David H. Brown

*Attorney, Agent, or Firm*—LeBlanc, Nolan, Shur & Nies

[57] ABSTRACT

An omni-directional impact actuating mechanism for utilization in actuating a system such as a munition device. By utilizing a multi-directional impact sensor the munition device becomes omni-directional in that it can be detonated when receiving an impact force from any angle. The omni-directional actuating mechanism includes: an actuating member which is movable between a first position and a second position, a control mechanism for switching the actuating member between its two positions and an impact sensor which serves to operate the control mechanism for switching the actuating member. The control mechanism itself is switchable between a first condition for initially applying a force for restraining the actuating member in its first position and a second condition for subsequently applying a force for moving the actuating member into its second position. The impact sensor in response to certain impact forces upon the munition device causes the control mechanism to switch from its first into its second condition.

32 Claims, 4 Drawing Figures

FIG. 2
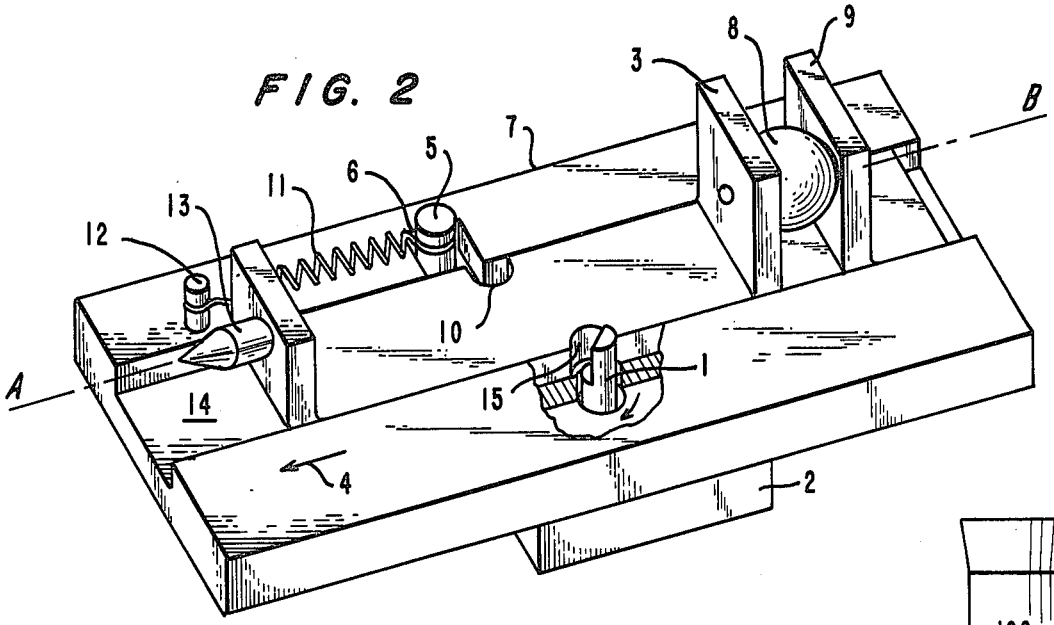
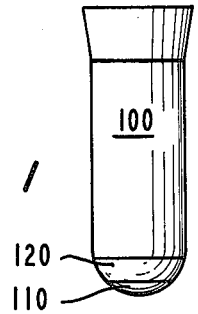
FIG. 1
FIG. 3
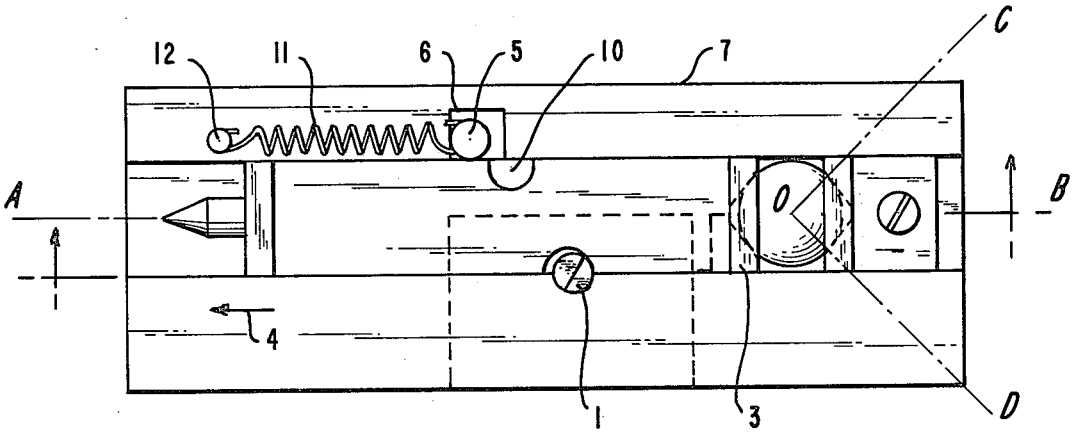
FIG. 4
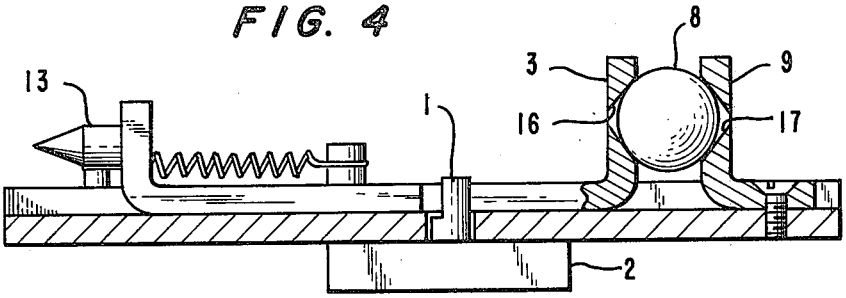

OMNI-DIRECTIONAL IMPACT ACTUATED SYSTEM

BACKGROUND OF THE INVENTION

The present invention relates to a munition device having an impact sensitive actuating mechanism.

Munition devices, such as bombs, or various types of missiles are typically provided with a direct impact detonating system arranged in the front portion. Such detonating systems are devised to set off a train of explosives within the munition device upon sufficient impact on the front of the device when it hits the target. The level of the impact force when the device hits the target is dependent upon the acceleration of the device. Occasionally, however, either the munition device does not impact the target at a steep enough angle so as to provide an appropriate impact force on the front of the device or the primary detonating system fails to operate due to some defect in the system. Such problems are especially incurred in non-rotating weapons or weapons which have ceased to spin prior to activating the direct impact sensor or where the weapons are spinning at a relatively low rate so that the impact sensor is not activated.

The present invention is described primarily in connection with the utilization of the impact actuating mechanism in a bomb or missile or similar munition device, since these are the primary contemplated areas of utilization. It, however, is recognized that the omni-directional impact actuating mechanism of the present invention can be utilized in conjunction with actuating other types of systems.

SUMMARY OF THE INVENTION

An object of the present invention is to provide an improved detonating system for a munition device.

Another object of the present invention is to provide a detonating system for a munition device having an improved impact actuating mechanism so as to be capable of being activated from any direction.

A further object of the present invention is to provide an omni-directional impact response mechanism.

A still further object of the present invention is to provide an actuating mechanism that is responsive to impact forces from any direction spanning an angle of 360 degrees.

These objectives of the present invention are achieved by utilizing the omni-directional impact sensitive actuating mechanism of the present invention. By utilizing such an omni-directional actuating mechanism either alone or in conjunction with a standard type of primary initiating mechanism typically utilized in a munition device, the munition device can be made sensitive to impact with the target from any angle. These two impact sensors appropriately placed within the munition device would ensure an effective zone of impact of 360° and hence, no matter what the attitude of the munition device when impacting the target, the explosive train would still be initiated.

The actuating mechanism includes an actuating member which is arranged so as to be movable along a guide member between a set position in which it is sensitive to an impact force and an actuating position in which it serves to initiate the detonating of the munition device. A control mechanism is provided for switching the actuating member between its set position and actuating position. The control mechanism itself is switchable between a first condition for initially applying force for restraining the actuating member in its set position and a second condition for subsequently applying a force for moving the actuating member into its actuating position. An impact sensitive mechanism which is responsive to forces impacting directly upon the munition device and indirectly upon the actuating mechanism serves to cause the control mechanism to switch from its first condition to its second condition.

The multi-directional sensor of the present invention can be constructed so as to be sensitive to impact forces received from any direction spanning an angle of approximately 360°. Such an impact sensor can be utilized either alone or in combination with another type of primary initiator in an actuating mechanism according to the present invention. In both situations, an actuating mechanism is provided which is sensitive to any impact force received through an entire zone of impact of 360°. Utilizing such an actuating mechanism having a complete omni-directional impact zone, irrespective of the attitude of the munition device when impacting upon a target, the explosive train still will be initiated. In this manner, the drawback prior of munition devices that require direct impact with the target is effectively eliminated.

By appropriately constructing the actuating mechanism of the present invention, such as by varying the sizes and frictional forces exerted by the various members, the actuating mechanism can be made sensitive to different levels of impact forces. In general, however, for munition devices, the actuating mechanism should be capable of being actuated when receiving an impact force of 50 g. or greater. The level of impact force of the munition device on a target depends upon the acceleration of the device during its path of travel prior to impact. As will be explained in greater detail below, however, the minimum required impact force for activating the actuating device can be so varied so as to be extremely small, such as, for example, as low as 5 g.

The actuating mechanism of the present invention includes a slidable actuating member that slides along a guide member between a set position and an actuating position. In the actuating position, the actuating member serves to initiate the detonating of the munition device. The movement of the slidable actuating member is controlled by the control mechanism which is switchable between a first condition for initially applying a force for restraining the slidable actuating member in its set position and a second condition for subsequently applying a force for moving the slidable actuating member into its actuating position. The control mechanism includes a spring and a member biased by the spring so as to bear against the slidable actuating member for applying a frictional restraining force to the slidable member. The spring biased member is normally held in a fixed position. This restraining force is applied when the control mechanism is in its first condition. The slidable actuating member has an indentation on one side thereof adjacent to the location of the spring biased member so that when the slidable actuating member is moved by a slight amount, the spring biased member enters this indentation. The spring biased member is then released from its fixed position and the spring, through the spring biased member, applies a force for moving the slidable actuating member to its actuating position. The slight movement in the slidable actuating member is provided through the impact sensor which is responsive to multi-directional impact forces.

The slidable actuating member has an L-shaped portion at one longitudinal end. This L-shaped portion has a conical, or spherical, impression in its surface that faces in a direction away from the actuating member. The impact sensor includes an end plate that has an opposing conical, or spherical, surface. This end plate is arranged so that its conical surface faces and is in juxtaposition with the conical surface of the L-shaped portion of the actuating member. A ball is positioned and held between the conical surfaces. The forces holding the ball in place are small enough that an impact force upon the actuating mechanism causes the ball to become dislodged. Dislodging of the ball causes movement of the actuating member by a slight distance. This slight movement in turn is sufficient to cause the control mechanism to be switched into its second condition, i.e., the slidable member moves by a sufficient distance so that the spring biased member enters the indentation which then causes the actuating member to be moved to its actuating position.

By varying both the size of the ball and the sizes of the corresponding conical surfaces along with the characteristics of the surfaces, the level of the impact force necessary to dislodge the ball can be controlled. In order to provide for the munition device to be actuated by forces of 50 to 100 g. or greater, a stainless steel ball having a diameter of $\frac{1}{4}$ inch can be employed. The utilization of a larger ball while maintaining the sizes of the conical surfaces would enable the construction of a device that is responsive to smaller forces. Conversely, with the utilization of a smaller ball and the same size conical surfaces, the mechanism would be less sensitive and require the application of larger impact forces in order to activate the impact sensor.

BRIEF DESCRIPTION OF THE DRAWINGS

FIG. 1 is a side elevational view of a bomb utilizing the actuating mechanism of the present invention.

FIG. 2 is a top perspective view of a portion of the actuating mechanism of the present invention.

FIG. 3 is a top plan view of the mechanism illustrated in FIG. 2.

FIG. 4 is a side elevational view of the mechanism illustrated in FIG. 2.

DESCRIPTION OF THE PREFERRED EMBODIMENTS

A munition device, such as bomb 100 shown in FIG. 1, can have a detonating mechanism for activating a series or train of explosives. The detonating mechanism includes an actuating mechanism which has two components. The first component is a primary impact initiator, labeled as 110 in FIG. 1, and the second component is an omni-directional impact mechanism, labeled as 120 in FIG. 1. The primary impact initiating portion, which can be of any conventional type, sets off the train of explosives when the bomb strikes target at any direct impact angles between angle COD as shown in FIG. 3. If the bomb impacts with the target at any other angle or if the direct impact force fails to set off the train of explosives, then second component 120 of the actuating mechanism serves to activate the series of explosives.

This second component 120 of the actuating mechanism is illustrated in FIGS. 2, 3 and 4. As shown in FIG. 2, this second component, which is multi-directional sensitive, of the activating mechanism includes a slidable actuating member 3 which slides along a guide channel 14. Slide member 3 is movable between a set position and an actuating position. In the figures, the slide member is shown in its set position.

Prior to the time that the actuating mechanism is to be utilized, it can be locked in its set position. In order to lock the actuating member in its set position, a half shaft 1 can be provided for extending into an indentation 15 on one side of slide member 3. Shaft 1 is connected to a timing clock assembly 2. At a set time, shaft 1 is rotated through a predetermined angle, approximately 90 degrees, which then allows slide member 3 to move in the direction of arrow 4 when initiated by impact of the bomb with the target. Prior to the time that the mechanism is to be enabled, however, half shaft 1 remains in contact with indentation 15 thereby preventing movement of the actuating member and detonation of the bomb.

Timing clock assembly 2 may be started by acceleration, a pull of a lanyard or a number of other release mechanisms. The time delay before rotation of half-shaft 1 should be sufficiently long so as to provide safety to the munition dispensing crew.

After slide actuating member 3 is enabled, by release of, or rotation of, half shaft 1, the actuating member is held in place by a small amount of friction resulting from the force of the movable spring biased stud 5. Stud 5 is forced against the side of slide actuating member 3 by the angle of cut-out 6 in the plate 7 of the actuating mechanism. Cut-out 6 acts as a cam surface, spring 11 exerts a force pulling spring biased stud 5 in the direction of arrow 4. Since the stud bears against cut-out 6, a force is applied against the side of the actuating member. As can be seen from FIG. 3, when the actuating member is in its set position, stud 5 bears against its side and hence applies a frictional force tending to restrain the actuating member in such set position. The angle of cut-out 6 should preferably be 90° to provide the greatest sensitivity.

At one end of actuating member 3 there is an L-shaped portion. This L-shaped portion has a conical, or spherical, impression 16 in its surface, which impression faces in a direction away from the actuating member. As shown in FIG. 4, an opposing conical, or spherical, surface 17 is provided in an end plate 9. End plate 9 forms a portion of the impact sensitive mechanism. A ball 8 is held between conical surfaces 16 and 17. The forces holding ball 8 in place depend upon the relative sizes of the conical surfaces and the ball along with the characteristics of the surfaces. By varying the relative sizes the level of force can likewise be varied and hence the impact mechanism can be made either more or less sensitive to impact forces.

An acceleration of sufficient magnitude within the angular range of effectivity of the actuating mechanism, such as by impact of the mechanism with the target, causes ball 8 to be dislodged thereby causing movement of slide actuating member 3 along channel 14 in the direction of arrow 4. While this initial movement of slide member 3 is only a slight limited movement, it is sufficient to cause stud 5 to enter indentation 10 in the side of actuating member 3. When stud 5 enters the indentation, it is released from cam surface 6 thereby allowing the stud to move in the direction of arrow 4. Spring 11, which is secured to fixed stud 12, applies a force to spring biased stud 5 to draw the biased stud in the direction of arrow 4 which in turn moves actuating member along guide channel 14 so as to move actuating pin 13 towards point A. Actuating pin 13 serves as a firing pin and initiates the train of explosives. Alternatively, actuating pin 13 also could serve to close a switch if it is desirable to perform an electrical function.

Consequently, actuating pin 13 is not moved and the actuating system is not operated until two conditions have occurred. First the actuating member must be enabled by time clock assembly 2 and second an acceleration of sufficient magnitude must be obtained in order to cause the sensing mass, ball 8, to become dislodged thereby causing slide member 3 to move a sufficient distance to allow spring biased stud 5 to engage indentation 10 and switch the slide member to its actuating position. Prior to such operation, spring biased stud 5 bears against cam surface 6 in plate 7 and applies a frictional force for restraining slide actuating member 3 in its set position.

The sensitivity of the impact sensor depends upon the location of the fixed spring stud 12, the angle of cam surface 6 in plate 7, the level of friction between movable stud 5 and the side surface of actuating member 3. The device can be made less sensitive, i.e., responsive only to higher acceleration levels, by providing an indentation in slide actuating member 3 into which movable stud 5 would rest in its initial position. When the stud bears against a slight indentation in actuating member 3 which is in a set position, the movable stud is still held in place by cam surface 6 and hence the actuating member is biased by even a greater force against movement. With the provision of a slight indentation in slide member 3, the ball would have to overcome a greater force in order to initiate the mandatory slight movement of the actuating member so as to cause the movable stud to be forced out of the slight indentation and into indentation 10.

The present invention may be embodied in other specific forms without departing from the spirit or essential characteristics thereof. The present embodiments of the invention are presented merely as illustrative and not restrictive, with the scope of the invention being indicated by the attached claims rather than the foregoing description. All changes which come within the meaning and range of equivalency of the claims are therefore intended to be embraced therein.

I claim:

1. An actuating mechanism comprising:

an actuating member movable between a set position and an actuating position;

control means switchable between a first condition for initially applying a force for restraining said actuating member in its set position and a second condition for subsequently applying a force for moving said actuating member into its actuating position; and impact sensing means responsive to impact forces upon said actuating mechanism and in response to such impact forces causing said control means to switch into its second condition.

2. An actuating mechanism according to claim 1 wherein said impact sensing means includes means for providing a force for moving said actuating member a sufficient distance so as to cause said control means to be switched into its second condition.

3. An actuating mechanism according to claim 1 further comprising a guide member; wherein said actuating member is a slidable member and is arranged so as to slide along said guide member and said control means in its first condition provides a frictional force for restraining said slidable member in its set position.

4. An actuating mechanism according to claim 3 wherein said impact sensing means includes means for providing a force for moving said slidable member against the force of said control means by a sufficient distance so as to cause said control means to be switched into its second condition.

5. An actuating mechanism according to claim 4 wherein: said control means includes a spring and a member biased by said spring in a fixed position so as to bear against said slidable member for applying a frictional restraining force thereto when said control means is in its first condition; said slidable member has an indentation on one side thereof adjacent to the location of said spring biased member so that when said slidable member is moved by the force of said impact sensing means, said spring bias member enters said indentation and is released from its fixed position and said spring through said spring biased member then applies a force for moving said slidable member to its actuating position.

6. An actuating mechanism according to claim 1, 2, 3, 4 or 5 wherein said impact sensing means includes means sensitive to an impact that is substantially omni-directional.

7. An actuating mechanism according to claim 1, 2, 3, 4 or 5 wherein said impact sensing means includes a spherical member responsive to impact forces upon said actuating mechanism from any direction spanning an angle of 360°.

8. An actuating mechanism according to claim 1, 2, 3, 4 or 5 further comprising locking means switchable between a locked position for preventing movement of said actuating member and an unlocked position for allowing movement of said actuating member.

9. An actuating mechanism according to claim 8 wherein said locking means includes a time delay control means for retaining said locking means in a locked position for a set time period after actuation of said time delay control means.

10. An actuating mechanism according to claim 2, 4, or 5 wherein: said actuating member has an L-shaped portion at one longitudinal end thereof and said L-shaped portion has a conical surface facing in a direction away from said actuating member; said impact sensing means includes an end plate having a conical surface, said end plate being arranged so that its conical surface faces and is in juxtaposition with said conical surface of said L-shaped portion of said actuating member, and a ball positioned between said conical surfaces such that an impact force upon said actuating mechanism causes said ball to become dislodged and movement of said ball causes movement of said actuating member.

11. An actuating mechanism according to claim 10 wherein the size and shape of said conical surface and said ball are appropriately constructed so that said ball is held in place by said conical surfaces by a sufficient force that a minimum force of approximately 50 to 100 g must impact on said actuating mechanism in order to dislodge said ball.

12. An actuating mechanism according to claim 10 wherein said impact sensing means includes means sensitive to an impact that is substantially omni-directional.

13. An actuating mechanism according to claim 12 further comprising locking means switchable between a locked position for preventing movement of said actuating member and an unlocked position for allowing movement of said actuating member.

14. An impact responsive mechanism comprising:

an elongated slidable member slidable between a first position and a second position;

control means switchable between a first condition for initially applying a force for restraining said slidable member in its first position and a second condition for subsequently applying a force for moving said slidable member into its second position; and an omni-directional impact sensing means responsive to impact forces upon said impact responsive mechanism and in response to such impact forces causing said control means to switch into its second condition.

15. An impact responsive mechanism according to claim 14 wherein said impact sensing means includes means for providing a slight force for moving said slidable member a sufficient distance so as to cause said control means to be switched into its second condition.

16. An impact responsive mechanism according to claim 14 further comprising a guide member arranged around said slidable member; wherein said slidable member is arranged so as to slide along said guide member and said control means in its first condition provides a frictional force for restraining said slidable member in its set position.

17. An impact responsive mechanism according to claim 16 wherein said impact sensing means includes means for providing a force for moving said slidable member aginst the force of said control means by a sufficient distance so as to cause said control means to be switched into its second condition.

18. An impact responsive mechanism according to claim 17 wherein said control means includes a spring and a member biased by said spring in a fixed position so as to bear against said slidable member for applying a frictional restraining force thereto when said control means is in its first condition; said slidable member has an indentation on one side thereof adjacent to the location of said spring biased member so that when said slidable member is moved by the force of said impact sensing means, said spring biased member enters said indentation and is released from its fixed position and said spring through said spring biased member then applies a force for moving said slidable member to its actuating position.

19. An impact responsive mechanism according to claim 14, 15, 16, 17 or 18 further comprising locking means switchable between a locked position for preventing movement of said slidable member and an unlocked position for allowing movement of said actuating member.

20. An impact responsive mechanism according to claim 19 wherein said locking means includes a time delay control means for retaining said locking means in a locked position for a set time period after actuation of said time delay control means.

21. A munition device comprising an explosive and detonating means for detonating said explosive, said detonating means having a primary actuating means for actuating said detonating means when the front portion of said munition device impacts upon a target and a secondary omni-directional actuating means for actuating said detonating means when a portion of said munition device other than said front portion impacts upon a target, said secondary actuating mechanism including:

an actuating member movable between a set position and an actuating position;

control means switchable between a first condition for initially applying a force for restraining said actuating member in its set position and a second condition for subsequently applying a force for moving said actuating member into its actuating position; and, impact sensing means responsive to impact forces upon said munition device and in response to such impact forces causing said control means to switch into its second condition.

22. A munition device according to claim 21 wherein said impact sensing means includes means for providing a force for moving said actuating member a sufficient distance so as to cause said control means to be switched into its second condition.

23. A munition device according to claim 21 wherein said secondary actuating means further includes a guide member; wherein said actuating member is a slidable member and is arranged so as to slide along said guide member and said control means in its first condition provides a frictional force for restraining said slidable member in its set position.

24. A munition device according to claim 23 wherein said impact sensing means includes means for providing a force for moving said slidable member against the force of said control means by a sufficient distance so as to cause said control means to be switched into its second condition.

25. A munition device according to claim 24 wherein: said control means includes a spring and a member biased by said spring so as to bear against said slidable member for applying a frictional restraining force thereto when said control means is in its first condition; said slidable member has an indentation on one side thereof adjacent to the location of said spring biased member so that when said slidable member is moved by the force of said impact sensing means, said spring biased member enters said indentation and is released from its fixed position and said spring through said spring biased member then applies a force for moving said slidable member to its actuating position.

26. A munition device according to claim 21, 22, 23, 24 or 25 wherein said impact sensing means includes means sensitive to an impact that is substantially omni-directional.

27. A munition device according to claim 21, 22, 23, 24 or 25 wherein said impact sensing means includes a spherical member responsive to impact forces upon said munition device from any direction spanning an angle of 360°.

28. A munition device according to claim 21, 22, 23, 24 or 25 wherein said secondary actuating means further includes locking means switchable between a locked position for preventing movement of said actuating member and an unlocked position for allowing movement of said actuating member.

29. A munition device according to claim 28 wherein said locking means includes a time delay control means for retaining said locking means in a locked position for a set time period after actuation of said time delay control means.

30. A munition mechanism according to claim 22, 24, or 25 wherein said actuating member has an L-shaped portion at one longitudinal end thereof and said L-shaped portion has a conical surface facing in a direction away from said actuating member; said impact sensing means includes an end plate having a conical surface, said end plate being arranged so that its conical surface faces and is in juxtaposition with said conical surface of said L-shaped portion of said actuating member, and a ball positioned between said conical surfaces such that an impact force upon said munition device causes said ball to become dislodged and movement of said ball causes movement of said actuating member.

31. A munition device according to claim 30 wherein the size and shape of said conical surface and said ball are appropriately constructed so that said ball is held in place by said conical surfaces by a sufficient force that a minimum force of approximately 50 to 100 g must impact on said munition device in order to dislodge said ball.

32. A munition device according to claim 30 further comprising locking means switchable between a locked position for preventing movement of said actuating member and an unlocked position for allowing movement of said actuating member.

* * * * *